US008152657B2

(12) United States Patent
Green

(10) Patent No.: US 8,152,657 B2
(45) Date of Patent: Apr. 10, 2012

(54) APPARATUS FOR HANDLING GOLF BALL AND GOLF TEE

(76) Inventor: Charles W. Green, Florence, SC (US)

( * ) Notice: Subject to any disclaimer, the term of this patent is extended or adjusted under 35 U.S.C. 154(b) by 155 days.

(21) Appl. No.: 12/578,640

(22) Filed: Oct. 14, 2009

(65) Prior Publication Data

US 2010/0125007 A1 May 20, 2010

Related U.S. Application Data

(60) Provisional application No. 61/115,606, filed on Nov. 18, 2008.

(51) Int. Cl.
*A63B 57/00* (2006.01)

(52) U.S. Cl. ..... 473/386; 294/19.2

(58) Field of Classification Search ..... 473/386, 473/285, 132, 406; 293/19.1, 19.2
See application file for complete search history.

(56) References Cited

U.S. PATENT DOCUMENTS

| | | | | | |
|---|---|---|---|---|---|
| 3,744,542 | A * | 7/1973 | Stephens et al. | ..... | 473/406 |
| 4,714,250 | A * | 12/1987 | Henthorn | ..... | 473/386 |
| 4,819,938 | A * | 4/1989 | Hill | ..... | 473/386 |
| 5,080,357 | A * | 1/1992 | Wolf | ..... | 294/19.1 |
| 5,205,598 | A * | 4/1993 | Miller | ..... | 473/386 |
| 5,330,178 | A | 7/1994 | Geishert | | |
| 5,335,953 | A * | 8/1994 | Luther, Sr. | ..... | 294/19.2 |
| 5,499,813 | A | 3/1996 | Black | | |
| 5,632,696 | A * | 5/1997 | Nichols et al. | ..... | 473/386 |
| 5,669,646 | A * | 9/1997 | Fiocca et al. | ..... | 294/19.2 |
| 5,707,303 | A * | 1/1998 | Berkowitz et al. | ..... | 473/386 |
| 6,672,977 | B1 * | 1/2004 | Colbo et al. | ..... | 473/386 |
| 6,739,477 | B1 * | 5/2004 | Pascual | ..... | 294/19.2 |
| 2003/0069090 | A1 * | 4/2003 | Gill | ..... | 473/386 |
| 2003/0203772 | A1 * | 10/2003 | Paine | ..... | 473/386 |
| 2005/0020388 | A1 * | 1/2005 | Smith et al. | ..... | 473/386 |
| 2007/0021239 | A1 * | 1/2007 | Gates | ..... | 473/386 |

* cited by examiner

*Primary Examiner* — Steven Wong
(74) *Attorney, Agent, or Firm* — L.C. Begin & Associates, PLLC

(57) ABSTRACT

An apparatus for handling a ball and tee may include a body, a clamshell retainer, a biasing assembly, a drive assembly and a handle assembly. The body may include a first opening, a second opening and a chamber, and a handle assembly associated with the second opening of the body. The biasing assembly may be capable of being actuated by the handle assembly. The drive assembly may be capable of being actuated by the biasing assembly. The clamshell retainer may be associated with the second opening of the body. The clamshell retainer may have a pair of clasping members movable between an open position and a closed position to selectively carry the golf ball and a portion of the golf tee between the pair of clasping members. The pair of clasping members may be moved between the open position and the closed position based on actuation of the drive assembly.

8 Claims, 8 Drawing Sheets

APPARATUS FOR HANDLING GOLF BALL AND GOLF TEE

CROSS REFERENCE TO RELATED APPLICATION

This application claims the benefit of U.S. Provisional Application No. 61/115,606 filed on Nov. 18, 2008, the disclosure of which is incorporated by reference.

FIELD OF THE DISCLOSURE

The present disclosure relates generally to a golf apparatus, and, more particularly, to an apparatus for handling a golf ball and a golf tee.

BACKGROUND OF THE DISCLOSURE

Typically, a user playing golf needs to put a golf ball in a hole by using a golf club and by following a set of rules. The user places the golf ball on a tee before hitting the golf ball with the golf club for the first time. The tee includes a pin-shaped end portion and a platform-shaped end portion for supporting the ball. The pin-shaped end portion is inserted in the ground and the platform-shaped end portion is positioned at an elevation from the ground.

Generally, a person, such as a player or a caddy, may need to fix the tee in the ground and place the ball on the tee. Furthermore, the person may need to remove the golf ball from the hole after the golf ball has been putted. All these tasks require the person to bend down and fix/remove the golf ball and the tee. Bending down to fix/remove the golf ball and the tee may be inconvenient for the person. Particularly, people with a back problem may find it even more inconvenient to bend down to fix/remove the golf ball.

SUMMARY OF THE DISCLOSURE

An apparatus for handling a golf ball and a golf tee is provided. The apparatus may include a body that may include a first opening, a second opening and a chamber and a chamber that may be communicated with the first opening and the second opening. The apparatus may include a handle assembly that may be associated with the second opening of the body. Further, the apparatus may also include a biasing assembly that may be capable of being actuated by the handle assembly. Furthermore, the apparatus may also include a drive assembly that may be capable of being actuated by the biasing assembly. Moreover, the apparatus may include a clamshell retainer that may be associated with the second opening of the body. The clamshell retainer may have a pair of clasping members movable between an open position and a closed position to selectively carry the golf ball and a portion of the golf tee between the pair of clasping members. The pair of clasping members may be moved between the open position and the closed position based on actuation of the drive assembly.

BRIEF DESCRIPTION OF THE DRAWINGS

These and other features and advantages of the present disclosure will be apparent from the following detailed description of preferred embodiments and best mode, appended claims, and accompanying drawings in which:

Like reference numerals refer to like parts throughout the description of several views of the drawings.

DETAILED DESCRIPTION OF THE DISCLOSURE

The exemplary embodiments described herein provide detail for illustrative purposes and are subject to many variations in structure and design. It should be emphasized, however, that the present disclosure is not limited to a particular apparatus for handling a golf ball and a golf tee, as shown and described. It is understood that various omissions and substitutions of equivalents are contemplated as circumstances may suggest or render expedient, but these are intended to cover the application or embodiment without departing from the spirit or scope of the claims of the present disclosure. Also, it is to be understood that the phraseology and terminology used herein are for the purpose of description and should not be regarded as limiting.

The terms "a" and "an" herein do not denote a limitation of quantity, but rather denote the presence of at least one of the referenced items.

The use of "including," "comprising," or "having" and variations thereof herein is meant to encompass the items listed thereafter and equivalents thereof as well as additional items.

Further, the use of terms "first", "second", and "third", and the like, herein do not denote any order, quantity, or importance, but rather are used to distinguish one element from another.

Unless limited otherwise, the terms "configured," "disposed," "placed", "carried by" and variations thereof herein are used broadly and encompass direct and indirect attachments, couplings, and engagements. In addition, the terms "attached" and "coupled" and variations thereof are not restricted to physical or mechanical attachments or couplings.

Referring to FIGS. 1-6, an embodiment of an apparatus 1000 for handling a golf ball 1002 and a golf tee 1004 is shown.

Figure 1:
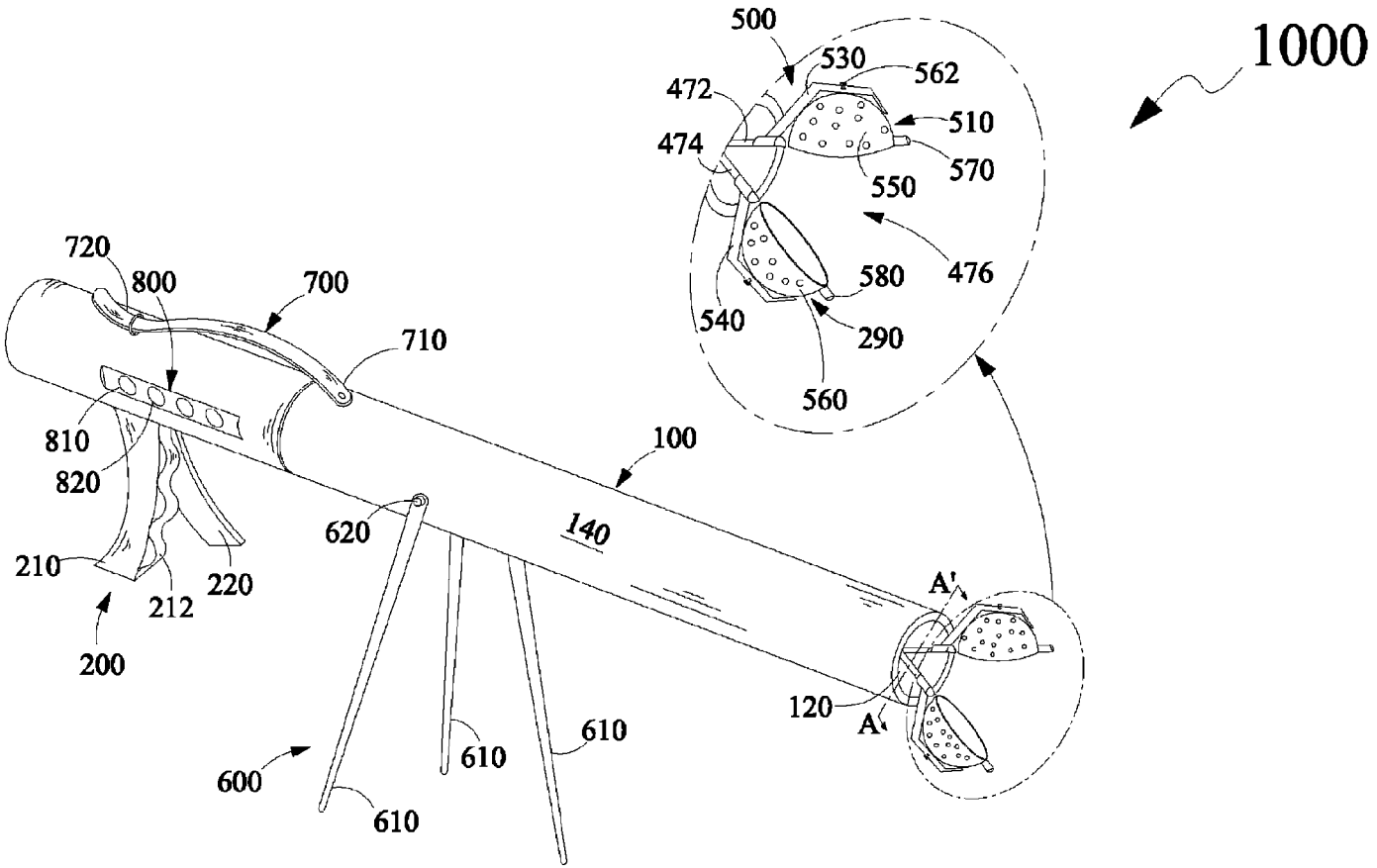
FIG. 1 is a perspective view of an embodiment of an apparatus for handling a golf ball and a golf tee.

The apparatus 1000 may include a body 100. The body 100 may be configured as an elongated cylinder, as depicted in FIG. 1. However, the body 100 may be formed in any other shape without departing from the spirit and scope of the disclosure. The body 100 may include a first opening 110 shown in the bottom view of the apparatus 1000 in FIG. 2. The body 100 may also include a second opening 120 as shown in FIG. 1. The body 100 may also include a chamber 130 shown in FIG. 4. The chamber 130 may be communicated with the first opening 110 and the second opening 120 during assembly.

Figure 2:
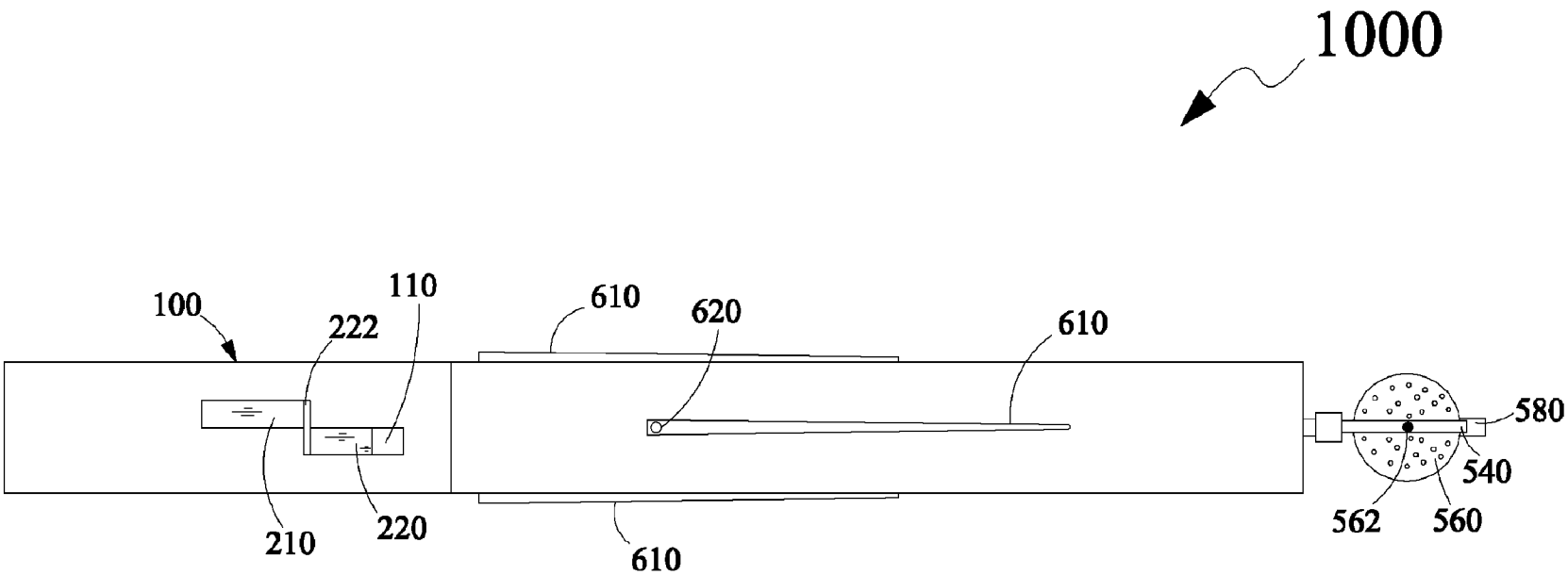
FIG. 2 is a bottom view of the apparatus of FIG. 1 showing a first opening of a body of the apparatus.

The apparatus 1000 may also include a handle assembly 200 associated with the first opening 110 of the body 100. Particularly, a portion of the handle assembly 200 extends outwards from the first opening 110, as shown in FIG. 2.

The handle assembly 200 may extend outward from the first opening 110. The handle assembly 200 may include a stationary handle 210. The stationary handle 210 may be coupled to the body 100 and may form an immovable component of the handle assembly 200. The stationary handle 210 may be coupled to the body 100 by utilizing an injection molding technique, adhesive material, nuts and bolts, and other similar coupling mechanisms. The stationary handle 210 may be composed of plastic, metal, rubber, and the like. The stationary handle 210 may be adapted to be held by a user, such as a golf player or a caddy. The stationary handle 210 may include a grip element 212 configured thereon. The grip element 212 may be configured to provide an ergonomic grip for holding the apparatus 1000. The grip element 212 may be made of a high friction material, such as rubber, compressed foam, and the like.

The handle assembly 200 may also include a movable handle 220. The movable handle 220 may be composed of plastic, metal, rubber, and the like. The movable handle 220 may be pivotally coupled with the stationary handle 210 for pivotal movement with respect to the stationary handle 210. Specifically, the movable handle 220 and the stationary handle 210 may be coupled through a handle hinge 222. The movable handle 220 may be capable of moving pivotally about the handle hinge 222 towards the stationary handle 210 upon application of a pressure on the movable handle 220 (as shown with an arrow in FIG. 4). Further, an end portion 224 of the movable handle 220 (shown in FIG. 4) may be displaced upon application of the pressure. Upon releasing the pressure, the movable handle 220 moves pivotally about the handle hinge 222 in a direction away from the stationary handle 210 (as shown with an arrow in FIG. 4). Thereafter, the movable handle 220 may assume an original position thereof.

The apparatus 1000 may include a biasing assembly 300 shown in FIGS. 4, 5 6, and 7. The biasing assembly 300 may be capable of being actuated by the handle assembly 200. The biasing assembly 300 may be carried by the body 100 within the chamber 130. The biasing assembly 300 may be operatively coupled to the movable handle 220.

The biasing assembly 300 may include a roller 310. The roller 310 may be configured to rotate based on the pivotal movement of the movable handle 220. The roller 310 may be cylindrical in shape and may be configured to rotate about a pin 245 that may be fixedly coupled to the body 100.

The biasing assembly 300 may also include a cord 320. The cord 320 may be composed of an elastic material, a flexible steel material, and other similar materials. The cord 320 may include a first end portion 322 and a second end portion 324.

The first end portion 322 may be coupled to the movable handle 220. Specifically, the first end portion 322 may be wound to the end portion 224 of the movable handle 220. The cord 320 may be configured to roll over the roller 310 based on the pivotal movement of the movable handle 220 (explained previously). Specifically, the cord 320 may be configured to roll over the roller 310. The cord 320 may roll over the roller 310 when the movable handle 220 is pressed and released.

Figure 4:
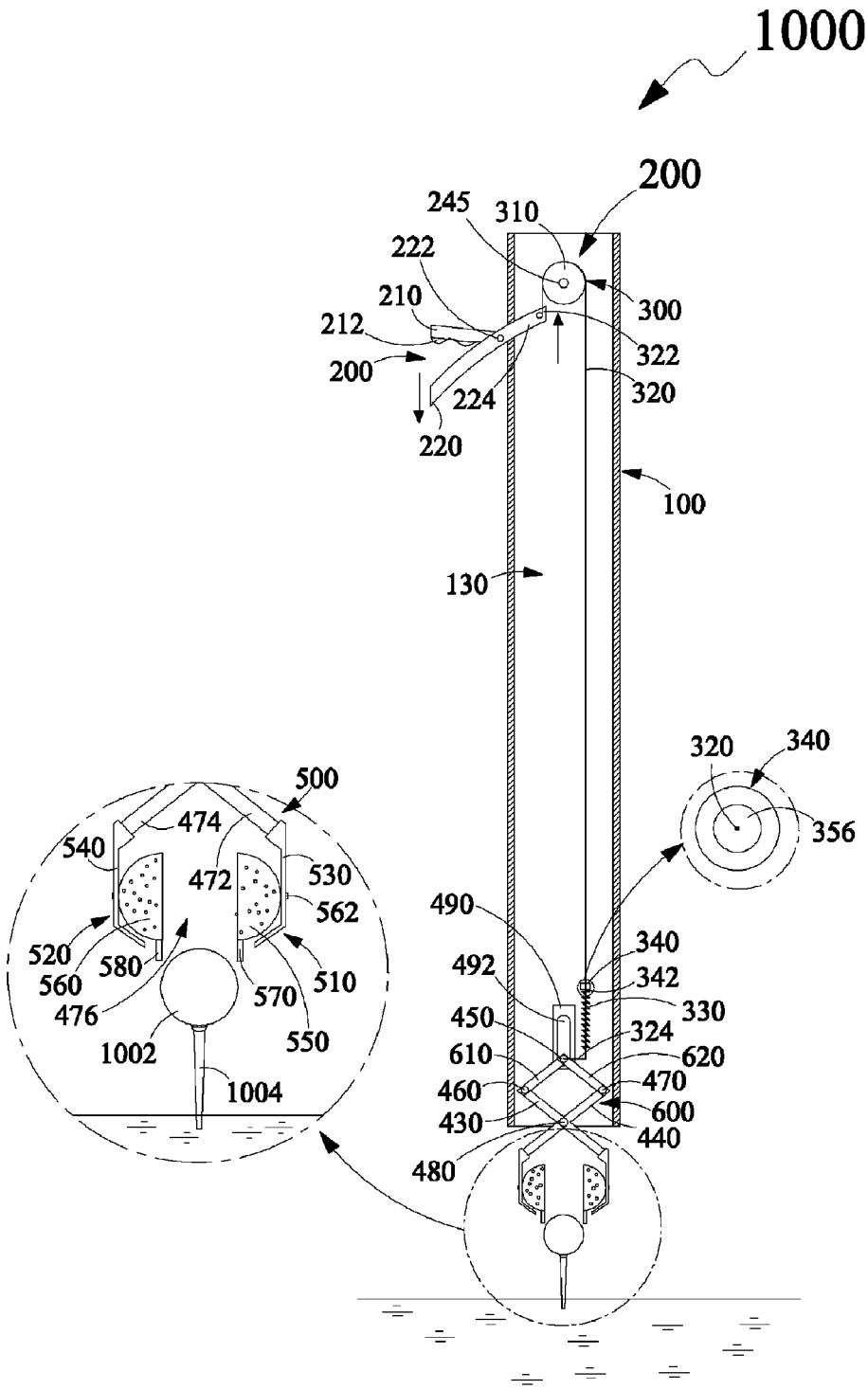
FIG. 4 is a sectional view of the body of the apparatus of FIG. 1 along a section line A-A' showing a clasping assembly when the pair of clasping members of the apparatus are spaced apart with a space formed therebetween.
Figure 6:
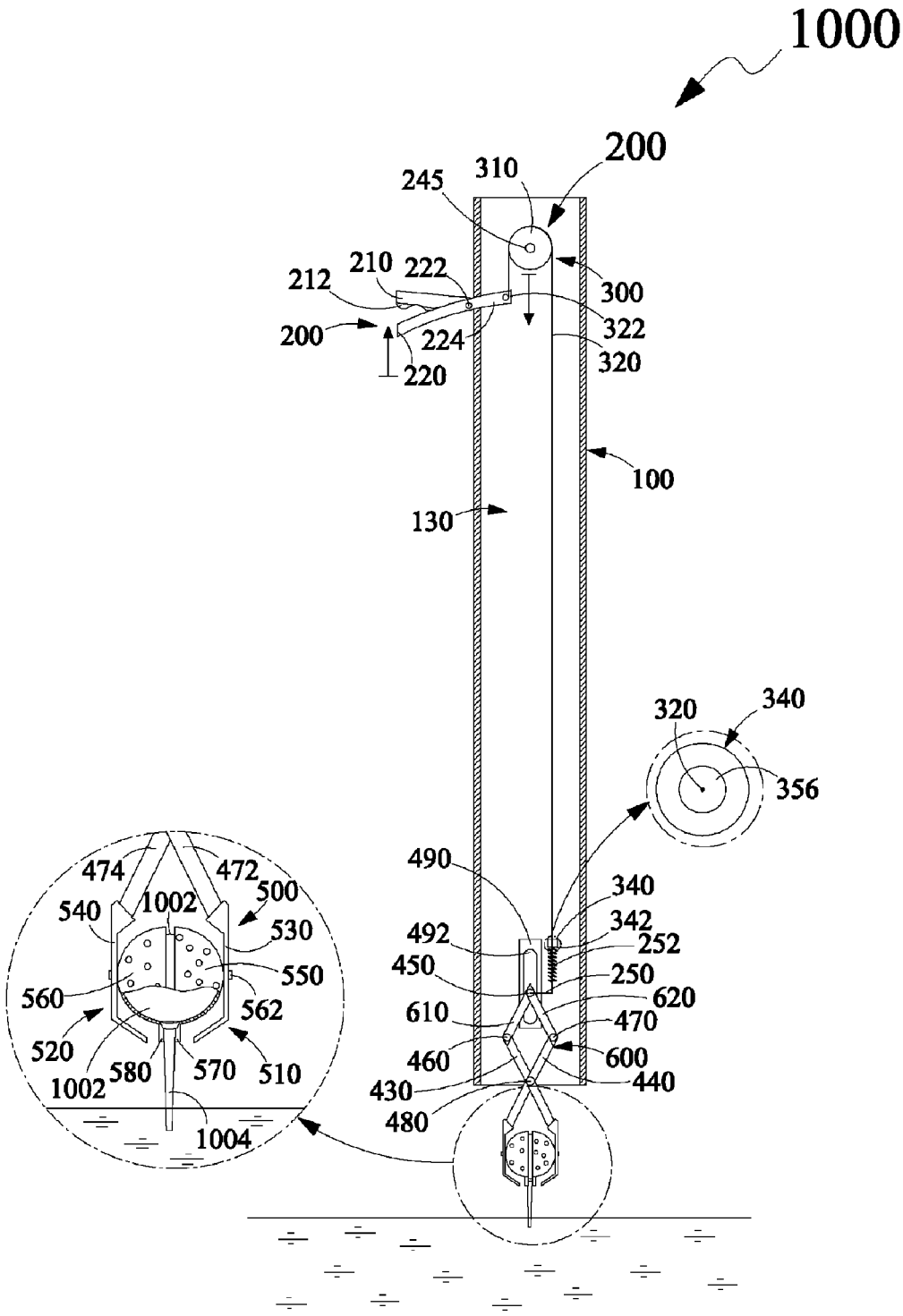
FIG. 6 is a sectional view of the body of the apparatus of FIG. 3 along a section line B-B' showing the clasping assembly gripping the golf ball and the golf tee.
Figure 7:
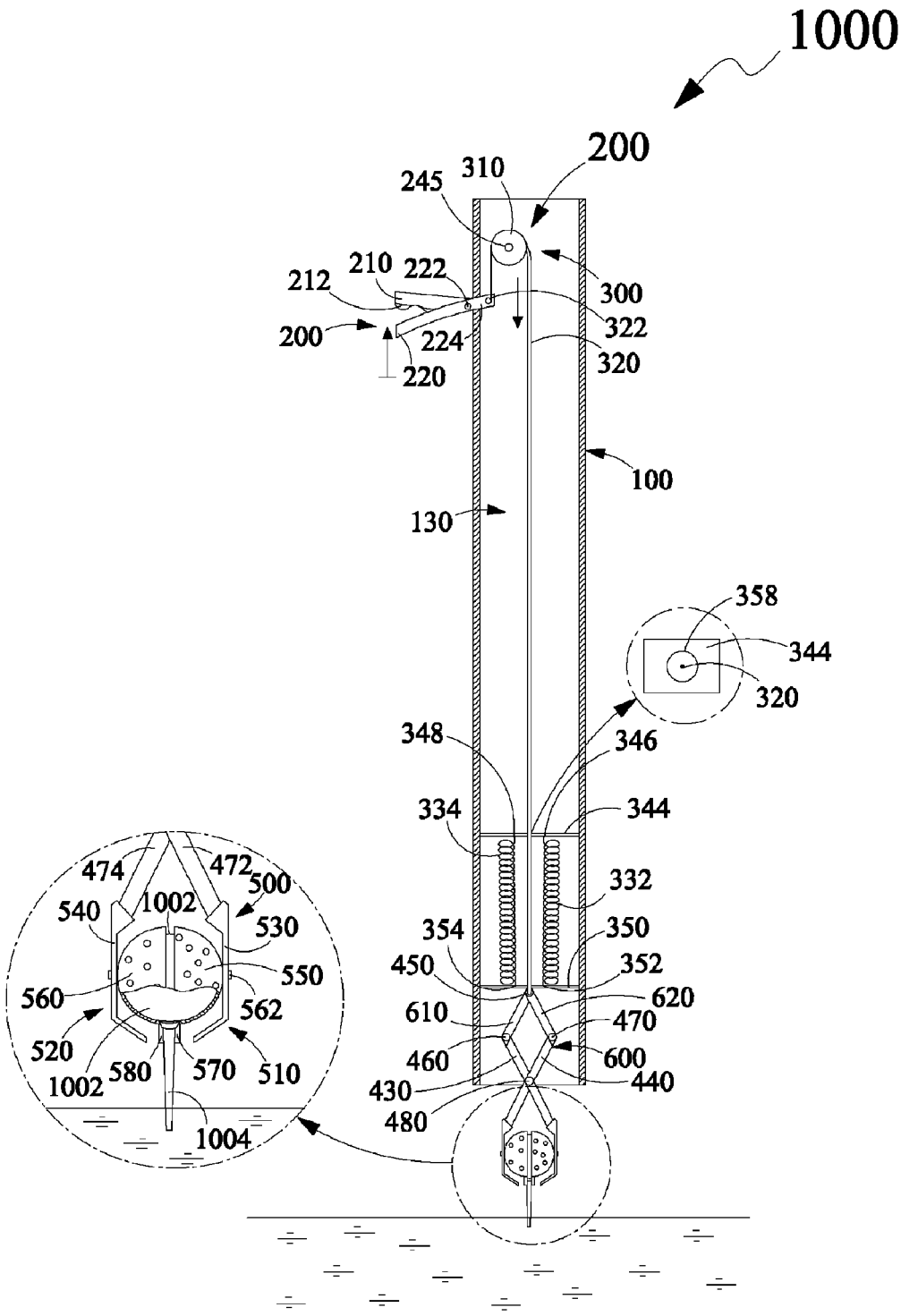
FIG. 7 is a sectional view of the body of the apparatus of FIG. 3 along a section line B-B' showing the clasping assembly gripping the golf ball and the golf tee, according to another embodiment of the present disclosure.
Figure 8:
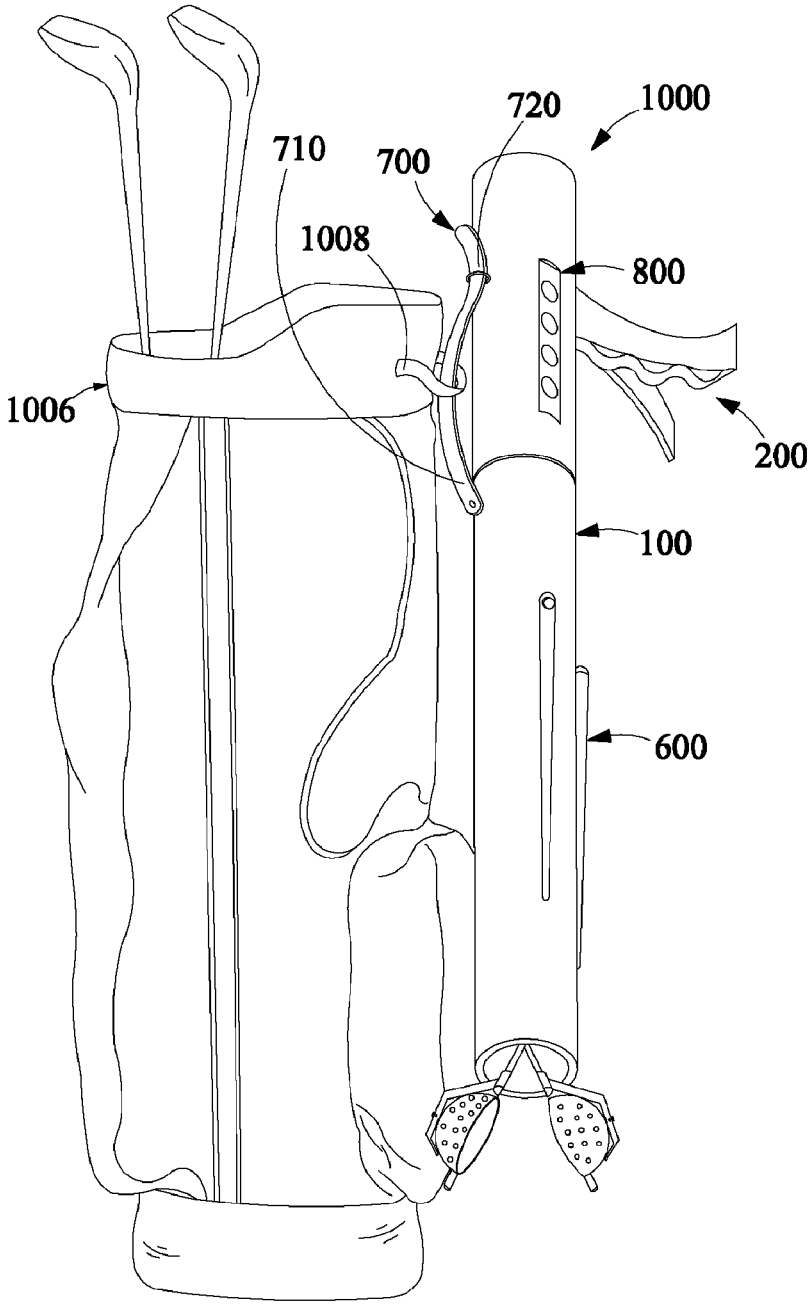
FIG. 8 is a perspective view of the apparatus of FIG. 1 showing a clip of the apparatus attached with a portion of a bag.

The biasing assembly 300 may also include at least one spring such as a spring 330. The spring 330 may be configured to expand and contract based on the rolling of the cord 320 over the roller 310 as shown in FIGS. 4 and 6. Alternatively, the biasing assembly 300 may include springs 332 and 334 configured to expand and contract based on the rolling of the cord 320 over the roller 310 as shown in FIGS. 5 and 7.

The biasing assembly 300 also may include a restraining member 340. The restraining member 340 may be fixedly coupled to the body 100. The restraining member 340 may be positioned near a first end portion 342 of the spring 330 such that the restraining member 340 may contact the first end portion 342 when the spring 330 contracts. Alternatively, the biasing assembly 300 also may include a stationary plate 344. The stationary plate 344 may be fixedly coupled to the body 100. The stationary plate 344 may be positioned near a first end portions 346 and 348 of the springs 332 and 334 respectively such that the stationary plate 344 may contact the first end portions 346 and 348 when the springs 332 and 334 contract. The biasing assembly 300 may also include a movable plate 350 that may be configured in the chamber 130. Second end portions 352 and 354 of the springs 332 and 334 may be fixedly attached to the moveable plate 350. Accordingly, the moveable plate 350 may be capable of longitudinal movement in the chamber 130 based on contractions of the springs 332 and 334.

Figure 5:
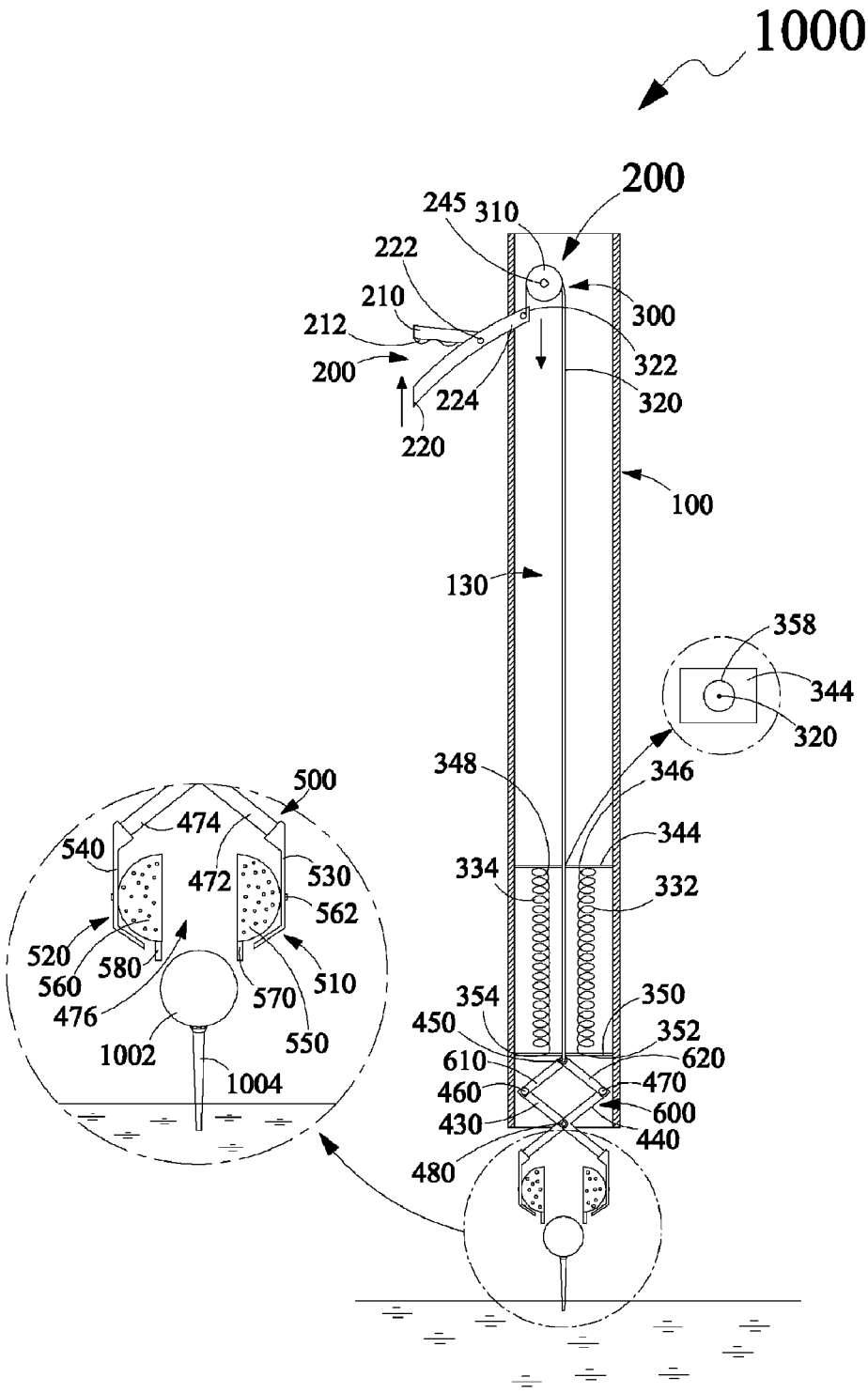
FIG. 5 is a sectional view of the body of the apparatus of FIG. 1 along a section line A-A' showing a clasping assembly when the pair of clasping members of the apparatus are spaced apart with a space formed therebetween, according to another embodiment of the present disclosure.

The restraining member 340 may include a slot 356 configured therein (shown in an enlarged front view of the restraining member 340, in FIGS. 4 and 5). The slot 356 may be configured to pass the cord 320 and restrain movement of the spring 330 wound over the cord 320 when the movable handle 220 is pressed. Specifically, a size of the slot 356 may be large enough to allow the cord 320 to pass through the slot 356. However, the size of the slot 356 restrains the spring 330 from passing through the slot 356. When the movable handle 220 is pressed, a tension develops in the cord 320 and may cause the cord 320 to roll over the roller 310 in a direction away from the spring 330. When the cord 320 moves in a direction away from the spring 330, the spring 330 wound over the cord 320 may get contracted due to combined effect of the tension in the cord 320 and the restrain in movement caused by the restraining member 340. When the movable handle 220 is released, the spring 330 may recoil and expand to an original shape of the spring 330. Recoiling of the spring 330 may pull the cord 320 and cause the cord 320 to roll over the roller 310 in a direction towards the spring 330. Alternatively, similar to the slot 356 configured on the restraining member 340, the stationary plate 344 may include a slot 358 configured therein (as shown in FIGS. 4 and 6).

The apparatus 1000 may also include a drive assembly 400 capable of being actuated by the biasing assembly 300.

The drive assembly 400 may be carried by the body 100 within the chamber 130. The drive assembly 400 extends partially outwards from the second opening 120 of the body 100. The drive assembly 400 may include a plurality of arm members. The plurality of arm members includes an arm member 410, an arm member 420, an arm member 430 and an arm member 440.

The plurality of arm members may be arranged in a zigzag arrangement, as shown in FIG. 4. Each pair of the plurality of arm members may be hingedly coupled at an intersection thereof. Specifically, the arm members 410 and 420 are hingedly coupled at an intersection thereof. Similarly, the arm members 410 and 430 are hingedly coupled at their intersection, the arm members 420 and 440 are hingedly coupled at their intersection and the arm members 430 and 440 are hingedly coupled at their intersection.

The arm members 410 and 420 are hingedly coupled by a first hinge 450 and form a first pair of arm members. The first hinge 450 may be coupled to the second end portion 324 of the cord 320 through a coupling mechanism, such as welding, soldering, sticking, winding the second end portion 324 about the first hinge 450, and the like. Accordingly, the first hinge 450 may be configured to longitudinally displace based on the rolling of the cord 320. The arm members 410 and 420 are hingedly coupled by a second hinge 460, the arm members 420 and 440 are hingedly coupled by a third hinge 470 and the arm members 430 and 440 are hingedly coupled by a fourth hinge 480. The arm members 430 and 440 form a second pair of arm members. The longitudinal displacement of the first hinge 450 upon pressing of the movable handle 220 causes the second hinge 460 and the third hinge 470 to be pushed toward each other. The fourth hinge 480 may be fixedly coupled to the body 100.

The second pair of arm members has a distal end portion 472 and a distal end portion 474 ("distal end portions") with a space 476 therebetween (as depicted in enlarged view of FIG. 1). The longitudinal displacement of the first hinge 450 controls the space 476 between the distal end portions of the second pair of arm members. Specifically, the longitudinal displacement of the first hinge 450 when the movable handle 220 may be pressed reduces the space 476 between the distal end portions, thereby configuring a closed position of the pair of clasping members. The longitudinal displacement of the first hinge 450 when the movable handle 220 is released increases the space 476 between the distal end portions thereby configuring an open position of the pair of clasping members. Accordingly, the space 476 between the distal end portions may be controlled by the longitudinal displacement of the first hinge 450. This enables selective carrying of the golf ball 1002 and a portion of the golf tee 1004 between the pair of clasping members.

The drive assembly 400 may also include a guide member 490. The guide member 490 may be an elongated structure with a rectangular cross-section. The guide member 490 may be composed of metal, plastic, or other similar materials. The guide member 490 may be fixedly attached to the body 100 with a coupling mechanism, such as welding, soldering, sticking, coupling with nuts and bolts, and the like. The guide member 490 may be coupled to the body 100 at an elevation of the first hinge 450. The guide member 490 may be coupled to the body 100 in a manner to elevate the guide member 490 to the elevation of the first hinge 450. The guide member 490 may include a slot 492 configured therewithin. The slot 492 extends along a length of the guide member 490. The slot 492 may be configured to accommodate the first hinge 450 and enables the first hinge 450 to longitudinally displace therewithin.

The apparatus 1000 may also include a clamshell retainer 500 associated with the second opening 120 of the body 100. The clamshell retainer 500 may have a pair of clasping members movable between an open position and a closed position to selectively carry the golf ball 1002 and a portion of the golf tee 1004 between the pair of clasping members. The pair of clasping members may be moved between the open position and the closed position based on actuation of the drive assembly 400.

The pair of clasping members may include a clasping member 510 and a clasping member 520 that are carried by the second pair of arm members at the distal end portions (as shown in enlarged view in FIGS. 4 and 5). The pair of clasping members may include a supporting member 530 and a supporting member 540 ("pair of supporting members"). Each supporting member of the pair of supporting members may be carried by a corresponding distal end portion of the distal end portions. The pair of clasping members may also include a cup 550 and a cup 560 ("pair of cups") that are capable of gripping at least one of the golf ball 1002 and the golf tee 1004. Each cup of the pair of cups may be carried by a corresponding supporting member of the pair of supporting members.

Specifically, the clasping member 510 may include the supporting member 530. The supporting member 530 may be coupled to the distal end portion 472 of the second pair of arm members through a coupling mechanism, such as molding, welding, soldering, sticking, and the like. The clasping member 510 may also include the cup 550 carried by the supporting member 530. In an embodiment, the cup 550 may be coupled to the supporting member 530 by a nut and a bolt arrangement 552. Alternatively, the cup 550 may be coupled to the supporting member 530 through a coupling mechanism, such as molding, welding, soldering, sticking, and the like. The cup 550 may be composed of a material such as rubber, plastic, metal, and the like. As shown, the cup 550 may be hemi-spherical in shape. However, the cup 550 may be of any other suitable shape.

Similarly, the clasping member 520 may include the supporting member 540. The supporting member 540 may be coupled to the distal end portion 274 of the second pair of arm members through a coupling mechanism, such as molding, welding, soldering, sticking, and the like. The clasping member 520 may also include the cup 560 carried by the supporting member 540. The cup 560 may be coupled to the supporting member 540 by a nut and bolt arrangement 562. Alternatively, the cup 560 may be coupled to the supporting member 540 through a coupling mechanism, such as molding, welding, soldering, sticking, and the like. The cup 560 may be composed of a material such as rubber, plastic, metal, and the like. As shown, the cup 560 may be hemispherical in shape. However, the cup 560 may be of any other suitable shape.

The pair of clasping members may be capable of gripping at least one of the golf ball 1002 and the golf tee 1004 based on the controlling of the space 476 between the distal end portions by the longitudinal displacement of the first hinge 450. Specifically, the cup 550 and the cup 560 are capable of gripping at least one of the golf ball 1002 and the golf tee 1004.

The clamshell retainer 500 may also include a pair of protruding members. The pair of protruding members may include a protruding member 570 and a protruding member 580 ("protruding members") carried by the pair of clasping members. Specifically, the protruding member 570 may be configured on the cup 550. The protruding member 570 may be semi-cylindrical in shape. Similarly, the protruding member 580 may be configured on the cup 560. The protruding member 580 may be semi-cylindrical in shape. The protruding members together may grip the golf tee 1004 when the movable handle 220 is pressed. A length of the protruding members protruding outwards from the pair of cups may be determined such that the protruding members may be able to stabilize the golf tee 1004 and may prevent the golf tee 1004 from wobbling when the golf ball 1002 and the golf tee 1004 are placed on the ground. In an embodiment of the present disclosure, the length of the protruding members may be equal to about one-fourth of a diameter of the golf ball 1002, that may stabilize the golf tee 1004 while still allowing the apparatus 1000 to scoop the golf ball 1002 directly off the ground or from within a hole. By way of another example, the protruding members can have a length within the range between one quarter of an inch and one half of an inch. Of course, the protruding members can have any other length.

Figure 3:
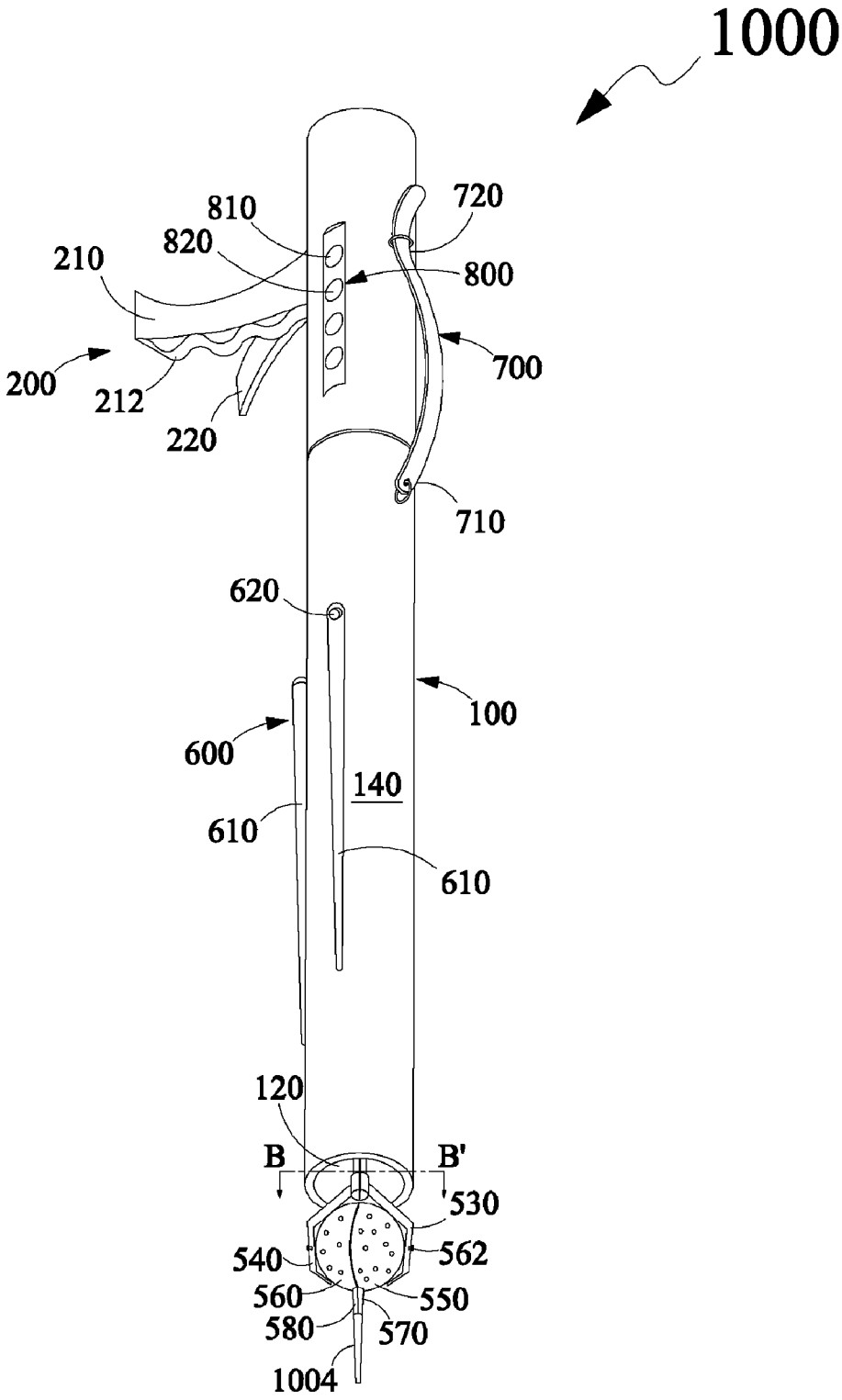
FIG. 3 is a perspective view of the apparatus of FIG. 1 showing a pair of clasping members of the apparatus gripping the golf ball and the golf tee.

The apparatus 1000 may also include a collapsible tripod stand 600 ("tripod stand 600") carried by an outer surface 140 of the body 100. The tripod stand 600 may include a plurality of support members 610 ("support members 610"). The support members 610 may be hingedly coupled to the outer surface 140 through a plurality of stand hinges 620 such that the support members 610 may be folded substantially parallel to the outer surface 140 (as shown in FIGS. 2 and 3) when the apparatus 1000 is not in use. The support members 610 may be positioned on the outer surface 140 in a predefined spatial pattern such that the body 100 may be held at an elevated position (as shown in FIG. 1).

The apparatus 1000 may also include a clip 700 carried by the outer surface 140 (as shown in FIG. 1). The clip 700 may be composed of a flexible material, such as plastic, metal, and the like. The clip 700 may include a first end portion 710 that may be fixedly attached to the outer surface 140 through a coupling mechanism, such as nuts and bolts, sticking, soldering, welding, and the like. Further, a second end portion 720 of the clip 700 may be adapted to be coupled to and removed from the outer surface 140 through a coupling mechanism, such as a buckle, snap-fit fasteners, hook and loop fasteners, latching mechanism, and the like. When the apparatus 1000 is required to be removably coupled to a bag 1006, the second end portion 720 may be decoupled from the outer surface 140. Thereafter, the clip 700 may be coupled with a portion 1008 of the bag 1006. The clip 700 may be adapted to be removably attached with the portion 1008 of the bag 1006 when the apparatus 1000 is not in use (as shown in FIG. 6).

The apparatus 1000 may also include a magnetic plate 800 carried by the outer surface 140 of the body 100 through coupling mechanisms, such as nuts and bolts, sticking, soldering, welding, and the like. The magnetic plate 800 has an elongated, flat structure. The apparatus 1000 may also include a plurality of metal discs. The plurality of metal discs may include a metal disc 810 and a metal disc 820 ("metal discs") carried by the magnetic plate 800. Specifically, the metal discs may be held on the magnetic plate 800 through magnetic attraction of the magnetic plate 800. Each metal disc of the metal discs capable of indicating a position of a golf ball, such as the golf ball 1002. The metal discs may be painted in different colors that represent different players. The metal discs painted in different colors may be utilized to mark positions of golf balls of different users on a golf course. Particularly, when a user needs to mark a position of his/her ball, he/she may decouple a metal disc, such as the metal disc 810, from the magnetic plate 800 and place the metal disc on the golf course. Thereafter, the golf ball may be replaced on the golf course at the position marked by the metal disc, and the metal disc may be coupled with the magnetic plate 800.

When not in use, the apparatus 1000 may be in a position as depicted in FIG. 1. Specifically, the movable handle 220 may be in a released position, the spring 330 is in original shape, the second hinge 460 and the third hinge 470 may be spaced apart from each other, the distal end portions of the arm members 420 and 440 may be spaced apart and the pair of clasping members may be spaced apart. When a user needs to handle an object such as the golf ball 1002 and the golf tee 1004, the user may position the pair of clasping members of the apparatus 1000 substantially over the object. Thereafter, the user may press the movable handle 220 for gripping the object. Pressing the movable handle 220 causes downward displacement of the end portion 224 of the movable handle 220. The end portion 224 may be coupled to the first end portion 322 of the cord 320. The downward displacement of the end portion 224 may exert a first pulling force on the cord 320.

The second end portion 324 of the cord 320 may be coupled to the first hinge 450, thereby causing a second pulling force to be exerted on the first hinge 450. The first hinge 450 may get longitudinally displaced within the slot 492 due to the second pulling force. The longitudinal displacement of the first hinge 450 may cause the spring 330 to contract due to combined effect of the restraining member 340 which may restrain the spring 330 from being displaced and the second pulling force which may cause displacement of the spring 330. Further, the longitudinal displacement of the first hinge 450 may cause the second hinge 460 and the third hinge 470 to move towards each other. Due to the hinged coupling of the second pair of arm members, the distal end portions may be pushed towards each other, based on the movement of the second hinge 460 and the third hinge 470. The pair of clasping members carried by the distal end portions may be pushed towards each other, thereby gripping the object over which the apparatus 1000 is placed.

Once the object is placed at a desired location, the pressure applied on the movable handle 220 may be released. Releasing of the pressure on the movable handle 220 may cause the spring 330 to recoil to the original shape. The recoiling of the spring 330 may exert a third pulling force on the cord 320, which, in turn, may pull the end portion 230 of the movable handle 220, thereby displacing the movable handle 220 to the released position. Further, the recoiling of the spring 330 may cause a longitudinal displacement of the first hinge 450 causing the second hinge 460 and the third hinge 470 to move away from each other. The movement of the second hinge 460 and the third hinge 470 may cause the distal end portions, and accordingly, the pair of clasping members to move away from each other, thereby releasing the gripped object.

An apparatus, such as the apparatus 1000 may be beneficial as it may enable a user to handle at least one of a golf ball and a golf tee conveniently. Particularly, the apparatus may enable the user to pick and place at least one of the golf ball and the golf tee from/into a ground surface without bending. The user may simply press a movable handle of the apparatus to grip the at least one of the golf ball and the golf tee. The movable handle may be configured at a second portion of the body 100 such that it may be conveniently reachable for the user and he/she may not need to bend. This may reduce a strain on the user's back that may be caused due to the bending. The apparatus may especially be useful for people suffering from back problems for whom bending is inconvenient. Further, when the apparatus is not in use, the apparatus may be positioned above a ground level using a collapsible tripod stand. The stand may enable the user to conveniently access the apparatus when required, without bending. Furthermore, a clip may be utilized to attach the apparatus to a bag for conveniently carrying the apparatus along with the bag from one place to another. Moreover, a magnetic plate may be utilized for indicating position of golf balls of different users on the ground level.

The foregoing descriptions of specific embodiments of the present disclosure have been presented for purposes of illustration and description. They are not intended to be exhaustive or to limit the present disclosure to the precise forms disclosed, and obviously many modifications and variations are possible in light of the above teaching. The embodiments were chosen and described in order to best explain the principles of the present disclosure and its practical application, to thereby enable others skilled in the art to best utilize the present disclosure and various embodiments with various modifications as are suited to the particular use contemplated. It is understood that various omissions and substitutions of equivalents are contemplated as circumstance may suggest or render expedient, but such are intended to cover the application or implementation without departing from the spirit or scope of the claims of the present disclosure.

What is claimed is:

1. An apparatus for handling a golf ball and a golf tee, the apparatus comprising:

a body having a first opening, a second opening and a chamber communicated with the first opening and the second opening;

a handle assembly associated with the first opening of the body;

a biasing assembly capable of being actuated by the handle assembly;

a drive assembly capable of being actuated by the biasing assembly; and a clamshell retainer associated with the second opening of the body, the clamshell retainer having a pair of clasping members movable between an open position and a closed position to selectively carry the golf ball and a portion of the golf tee between the pair of clasping members, wherein the pair of clasping members is moved between the open position and the closed position based on actuation of the drive assembly, and wherein the biasing assembly is carried by the body within the chamber, and wherein the biasing assembly is operatively coupled to the movable handle, the biasing assembly comprising, a roller configured to rotate based on the pivotal movement of the movable handle, a cord having a first end portion and a second end portion, the first end portion of the cord coupled to the movable handle, the cord configured to roll over the roller based on the pivotal movement of the movable handle, at least one spring, the at least one spring configured to expand and contract based on the rolling of the cord over the roller, and a restraining member fixedly coupled to the body, the restraining member having a slot configured therein, the slot configured to pass the cord and restrain movement of the at least one spring when the movable handle is pressed.

2. The apparatus of claim 1, wherein the at least one spring is configured to recoil when the movable handle is released.

3. The apparatus of claim 2, wherein the recoiling of the at least one spring releases at least one of the golf ball and the golf tee gripped by the pair of clasping members.

4. The apparatus of claim 1, wherein the drive assembly is carried by the body within the chamber, and wherein the drive assembly partially extends outward from the second opening of the body, the drive assembly having, a plurality of arm members arranged in a zigzag arrangement, each pair of the plurality of arm members hingedly coupled at an intersection thereof, the plurality of arm members having a first pair of arm members and a second pair of arm members, the first pair of arm members coupled by a first hinge, the first hinge coupled to the second end portion of the cord, the first hinge configured to longitudinally displace based on the rolling of the cord, the second pair of arm members having distal end portions with a space therebetween, the longitudinal displacement of the first hinge configuring the pair of clasping members in one of the open position and the closed position, and a guide member having a slot for accommodating the first hinge, the slot enabling the first hinge to longitudinally displace therewithin, the longitudinal displacement of the first hinge compressing the at least one spring.

5. The apparatus of claim 4, wherein the pair of clasping members are carried by the second pair of arm members at the distal end portions, the pair of clasping members capable of gripping at least one of the golf ball and the golf tee in the closed position.

6. The apparatus of claim 4, wherein the pair of clasping members comprises:

a pair of supporting members, each supporting member of the pair of supporting members carried by a corresponding distal end portion of the distal end portions of the second pair of arm members, and a pair of cups capable of gripping at least one of the golf ball and the golf tee, each cup of the pair of cups carried by a corresponding supporting member of the pair of supporting members.

7. The apparatus of claim 6, wherein the each cup of the pair of cups is hemi-spherical in shape.

8. The apparatus of claim 6, wherein the each cup of the pair of cups is composed of rubber.

* * * * *